US005341940A

United States Patent [19]

Pidcock

[11] Patent Number: 5,341,940

[45] Date of Patent: Aug. 30, 1994

[54] APPARATUS FOR THE RETRIEVAL AND REFILING OF DOCUMENTS IN FLAT FILE STORAGE DRAWERS

[76] Inventor: Ralph M. Pidcock, 2614 Greenleaf St., Allentown, Pa. 18104

[21] Appl. No.: 105,848

[22] Filed: Aug. 10, 1993

[51] Int. Cl.[5] ..... B07C 7/04

[52] U.S. Cl. ..... 209/702; 312/185; 402/80 R; 462/72; 462/76

[58] Field of Search ..... 312/183, 185; 462/34, 462/62, 30, 71, 72, 76, 78, 75; 402/80; 209/509, 702, 703

[56] References Cited

U.S. PATENT DOCUMENTS

| | | | |
|---|---|---|---|
| 512,267 | 1/1894 | Austrian . | |
| 782,773 | 2/1905 | Bohn . | |
| 794,827 | 7/1905 | Wiechers . | |
| 1,060,074 | 4/1913 | Fox . | |
| 1,202,831 | 10/1916 | Goslin . | |
| 1,212,083 | 1/1917 | Mayfield . | |
| 1,488,962 | 4/1924 | Ward . | |
| 1,596,225 | 8/1926 | Anderson . | |
| 1,696,375 | 12/1928 | Anderson . | |
| 1,764,613 | 6/1930 | Donnelley | 312/183 |
| 1,774,792 | 9/1930 | Eaton . | |
| 1,916,210 | 7/1933 | Furlong | 312/183 |
| 2,091,809 | 8/1937 | De Lisle | 129/26 |
| 2,490,147 | 12/1949 | Minton | 281/42 |
| 2,565,966 | 8/1951 | Jaffin | 281/42 |
| 2,821,452 | 1/1958 | May | 312/183 |
| 3,416,817 | 12/1968 | Gia-Quinto | 281/42 |
| 3,696,926 | 10/1972 | Syversen | 209/702 |
| 3,737,178 | 6/1973 | Tjernlund et al. | 281/42 |
| 5,169,255 | 12/1992 | Jensen | 402/80 |

*Primary Examiner*—Richard A. Schacher
*Attorney, Agent, or Firm*—Sanford J. Piltch

[57] ABSTRACT

A portable arrangement to allow a user to retrieve and then later refile a single sheet of single or multi-part architectural plans, blueprints, and/or any document from a flat storage file drawer. The portable arrangement allows the removal of a single sheet from a tightly packed stack of sheets without losing the place of the single sheet in the file and to replace the single sheet in the stack of sheets without disturbing the order in which the sheets are arranged. A first embodiment comprises an upright rack having opposite feet that are interconnected by a crossbar, a sheet separator, first clamping device, and second clamping device, said sheet separator having a tapered front portion and a device for being mounted on at least one transverse member which in turn has a device for slidingly coupling to runners of the storage drawer. The first clamping device having a surface for clampingly engaging at least one sheet located below the sheet desired to be extracted and the second clamping device having a surface for clampingly engaging at least one sheet located above the sheet desired to be extracted and further device to permit detachable hanging from the crossbar. In a second embodiment a dust cover capable of standing upright is utilized instead of the removable rack.

10 Claims, 2 Drawing Sheets

APPARATUS FOR THE RETRIEVAL AND REFILING OF DOCUMENTS IN FLAT FILE STORAGE DRAWERS

FIELD OF THE INVENTION

This invention relates to an arrangement for retrieving documents from a storage drawer, and more particularly, to a portable arrangement that allows for the retrieval and the later refiling of a single sheet of flat stacked, sequentially arranged, architectural and engineering plans and/or blueprints, tracings, manuscripts, sepia drawings, Mylar drawing reproductions, and the like from a flat storage file drawer without losing the sequential arrangement of the stacked sheets and without mutilating the sheets.

BACKGROUND OF THE INVENTION

Flat storage drawers for holding relatively large sheets, such as multi-part architectural and engineering plans and/or blueprints are well known. The relatively large sheets are laid flat and form one sequentially arranged stack, and when a sufficient amount of these sheets is present, it becomes difficult to retrieve a single sheet from the sequential stack without destroying the order in which the sheets are arranged, losing the place from where the sheet is retrieved, or mutilating the sheets. This difficulty is increased when the flat storage drawers are arranged in groups or tiers elevated a sufficient height from the floor so that a ladder is required in order to allow the user to gain access to the desired drawer and to then retrieve a single sheet from the flat sequential stack.

An arrangement to assist the user to retrieve documents from a flat storage drawer is disclosed in U.S. Pat. No. 2,091,807 ('807) issued Aug. 31, 1937. The '807 patent discloses a dust cover and rack apparatus that is raised upward through an arc and remains supported in an up position by bracket arms attached to either side of the drawer. The sheets located above the sheet desired to be retrieved are folded over and held in position on the rack apparatus by their aggregate weight, thereby allowing the desired sheet to be retrieved and later refiled. Even though the upper sheets are partially supported by the rack assembly, a portion of such upper sheets lie on the sheet desired to be retrieved and, hence, the weight of such upper sheets hinders the retrieval and refiling of the desired sheets. Such an encumbrance often may lead to tearing, creasing or misaligning of the sheets remaining in the storage drawer. Further, the rack assembly remains with the associated drawer and is of no use to a user trying to retrieve one or more sheets from another drawer. It is desired that a portable arrangement be provided to allow a user to retrieve one or more sheets from any flat storage drawer and also to allow the retrieved sheet to be free of any encumbrance caused by the weight of the remaining upper sheets.

Accordingly, it is an object of the present invention to provide a portable arrangement to allow a single user to remove a relatively large size sheet, such as an architectural or engineering plan or blueprint, from a flat sequential arrangement and not have the retrieved sheet encumbered by the weight of any of the remaining sheets.

It is a further object of the present invention to provide a portable arrangement having clamping means that are easily used to designate or preserve the sequence of the remaining sheets so that the retrieved sheet may be easily refiled back into its proper place without mutilating either the refiled sheet or any of the sheets remaining in the stack.

It is a further object of the present invention to provide a portable arrangement having means that allows one or more documents to be removed or replaced without tearing, creasing or misaligning any of the sheets in the flat storage drawer.

Still further, it is an object of the present invention to provide a portable arrangement that easily accommodates different sized flat storage drawers and, thereby, different sized retrievable sheets.

Further still, it is an object of the present invention to provide a portable arrangement to assist in the removal and refiling of a single relatively large sheet from a flat storage drawer, while at the same time be readily adapted to the provisions of the existing flat storage drawer.

Still further, it is an object of the present invention to provide a portable arrangement that is easily assembled and disassembled from any flat storage drawer.

SUMMARY OF THE INVENTION

The present invention is directed to a portable arrangement that easily allows a user to retrieve and then later refile one or more sheets of a multi-part architectural and engineering plans and/or blueprint from a flat storage file drawer without mutilating or destroying the sequence of the sheets in the drawer.

In one embodiment, the portable arrangement, used in a drawer having a predetermined width and runners, comprises an upright rack, a sheet separator with a tapered portion, first clamping means, and second clamping means. The upright rack has opposite feet that are interconnected by a crossbar. The sheet separator has means for being mounted on at least one transverse spanning member having means for slidably coupling to the runners or sides of the flat storage drawer. The first clamping means comprises at least one member having a surface for clampingly engaging at least one sheet located below the one or more sheets desired to be extracted. The second clamping means comprises at least one member having a surface for clampingly engaging at least one sheet located above the one or more sheets desired to be extracted and means to permit detachable coupling from the crossbar.

In a second embodiment, the upright rack means is not necessary because the second clamping means are detachably coupled to a dust cover member already existing in the storage drawer.

Other objects, advantages and novel features of the present invention will become apparent from the following detailed description of the invention when considered in conjunction with the accompanying drawings.

BRIEF DESCRIPTION OF THE DRAWINGS

For the purpose of illustrating the invention, there is shown in the drawings an embodiment of the invention which is presently preferred; it being understood, however, that this invention is not limited to precise arrangements and instrumentalities shown.

DETAILED DESCRIPTION OF THE PREFERRED EMBODIMENTS

Figure 1:
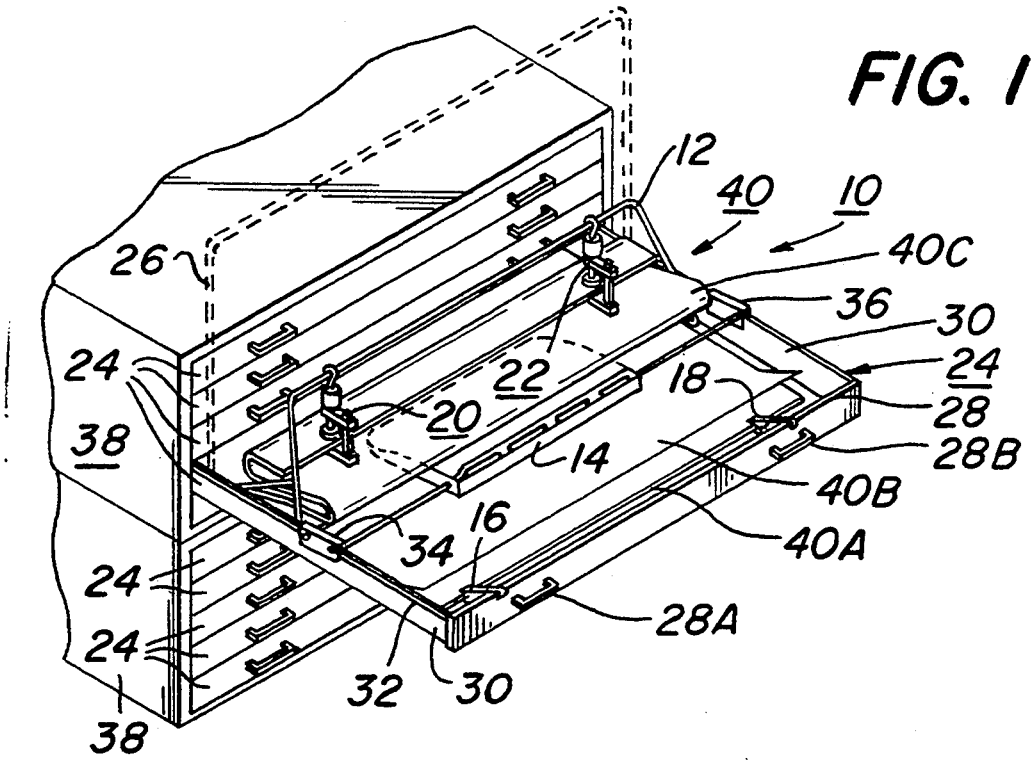
FIG. 1 is a perspective illustration showing the arrangement of the present invention for extracting at least one sheet from a plurality of sheets stacked in a flat storage drawer.

Referring now to the drawings wherein the same reference numbers indicate the same elements, there is shown in FIG. 1 a portable arrangement 10 of the present invention. The portable arrangement 10 allows for a single sheet of relatively large size plans to be removed from a flat, sequentially arranged and usually tightly packed stack without losing the place of the retrieved sheet in the stack for later refiling therein and without disturbing or destroying the sequence of the remaining papers therein.

The portable arrangement 10 comprises an upright rack 12, a sheet separator 14, first clamping means comprising spring action members 16, and 18, and second clamping means comprising adjustable members 20 and 22. The portable arrangement 10 is shown in FIG. 1 as being disposed within a flat storage drawer 24.

FIG. 1 shows a plurality of drawers 24 which may be of the type described in U.S. Pat. No. 2,821,452 ('452), here incorporated by reference. As discussed in the '452 patent, the drawer 24 may further comprise a dust cover 26 which may be arranged in an upright manner as generally outlined in phantom in FIG. 1. Drawer 24 is preferably formed of sheet steel and includes a front wall 28 having handles 28A and 28B attached thereto, a rear wall (not shown) and sidewalls 30. The sidewalls 30 have attached thereto runners 32 onto which slide members 34 and 36 associated with the sheet separator 14 are detachably and slidably coupled. The runners 32 are slidably and guidably mounted onto rollers (not shown) so that the drawer 24 may be easily opened and closed. The drawer 24 may have different widths such as 30", 36", 42" and 48" so as to accommodate correspondingly different sized stacked sheets of multi-part architectural and engineering plans or blueprints, or some other relatively large sized document 40. The stacked sheets 40 are shown in FIG. 1 for illustrating purposes as comprising a lower plurality 40A, a single sheet 40B, and an upper plurality 40C.

The drawers 24 are shown in FIG. 1 as being arranged one on top of another to form cabinets 38 that are supported by the floor. Further, the cabinets 38 may be arranged one upon another to form tiers. These tiers may be arranged in an upright vertical manner from the supporting floor at such a height so that a ladder is required to allow a person seeking to gain access to position himself or herself at the selected drawer so that at least one sheet 40B may be extracted. The portable arrangement 10 of the present invention eases the user's task in extracting such a sheet and may be further described with reference to FIG. 2.

Figure 2:
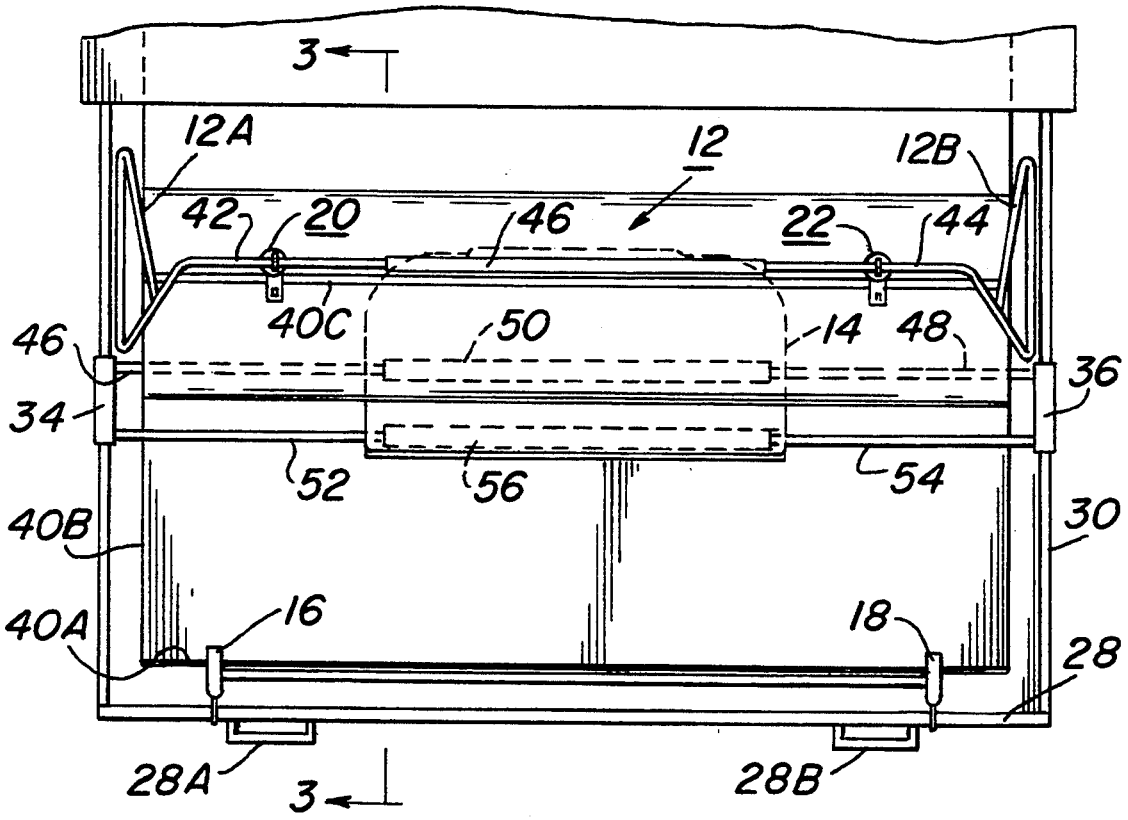
FIG. 2 is an illustration showing further details of the arrangement of FIG. 1.

As seen in FIG. 2, the upright rack 12 of the arrangement 10 has two oppositely disposed feet 12A and 12B respectively having horizontal extension members 42 and 44. The extension members 42 and 44 are interconnected by a tubular member 46. The members 42 44 and 46 form a crossbar for the upright rack 12. The members 42 and 44 are allowed to move within the tubular member 46 so that the width of the crossbar may be adjusted to be somewhat less than the variable width dimension of the drawer 24 so as to accommodate different width sized stacks 40.

As will be further discussed, the adjustable clamping devices 20 and 24 are preferably provided with an arrangement so as to permit detachable hanging from members 42 and 44 respectively. The adjustable devices 20 and 22 are clampingly engaged laterally inward from the respective edge of the upper plurality of sheets 40C by a predetermined distance that preferably corresponds to about 25% of the total width of the stack 40. Similarly, the spring action devices 16 and 18 are also clampingly engaged laterally inward from the edges of the lower plurality of sheets 40A by a predetermined distance, such as that which corresponds about 25% of the width of the stack 40. These 25% factors are not fixed quantities but may vary with the width, length and weight of the sheets that comprise stack 40.

The sheets separator 14 of the portable arrangement 10 is preferably centrally mounted on at least one, but preferably two, transverse spanning members wherein the first member is composed of rod members 46 and 48 and tubular member 50 (shown in phantom) and whereas the second member is composed of rod members 52 and 54 and tubular member 56 (also shown in phantom). Each end of each of the first and second spanning members are respectively attached to the slidable members 34 and 36.

The rod members 46, 48 and tubular member 50 and the rod members 52, 54, and tubular member 56 operate in a similar manner as members 42, 44 and 46 so that each of the spanning members, carrying the sheet separator 14, is adjusted to accommodate different width sizes of the drawer 24 so as, more importantly, to accommodate different width sizes of the stacks 40. The dimensions of any of the members that may support the weight of resting sheets, to be described, are selected so as to withstand such weight without encountering any bending thereof. The sheet separator 14 may be further described with reference to FIG. 3, which is a view taken along line 3—3 of FIG. 2.

Figure 3:
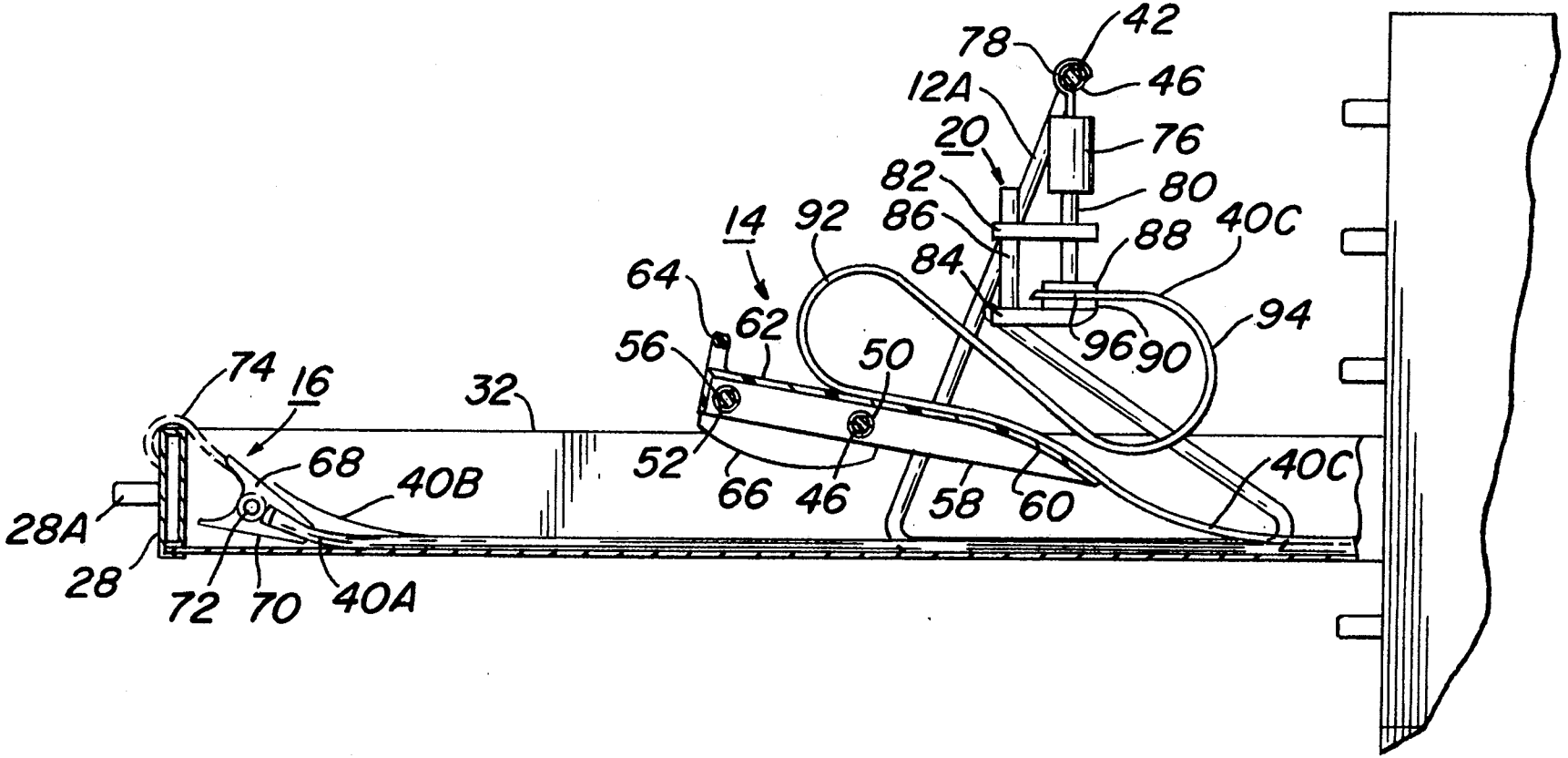
FIG. 3 is a view, taken along line 3—3 of FIG. 2, showing further details of the arrangement of FIG. 1.

The sheet separator 14 has a side member 58, a tapered front portion 60, a top surface 62 which is relatively smooth, a gripping member 64 which may be used to maneuver the plan separator 14, and an edge runner 66. As seen in FIG. 3, the plan separator 14 is oriented to be tilted so that its tapered front portion 60 more readily mates with the upper plurality of sheets 40C and so that the plurality of sheets 40C more easily rests upon the smooth surface 62. As seen in FIG. 3, the lower plurality of sheets 40A is yieldingly engaged by spring member 16.

Spring action member 16 and also spring action member 18 (not shown in FIG. 3) comprise a pair of lever members 68 and 70 that are joined at their intermediate portions by a coil spring member 72. The lever members 68 and 70 yieldingly respond to the spring action of member 72 which in turn yieldingly responds by being subjected to a pressing action applied to the lever members 68 and 70. The spring action members 16 and 18 may also, but not necessarily, further comprise a member 74 having a segment (shown in phantom) that fits over the front wall 28. Lever members 68 and 70 each have an inner surface which provides for frictional engagement of the lower plurality of sheets 40A. This inner surface of lever members 68 and 70 is selected so as to engage but not mar the sheets which the surfaces contact. The spring action of devices 16 and 18 causes the lever members 68 and 70 to be securely clamped to the lower plurality of sheets 40A. To release the engagement, a user need only press together lever member 68 and 70 allowing the respective first clamping means 16 or 18 to be withdrawn from the lower plurality of sheets 40A. The second clamping means 20, shown in FIG. 3, and its companion means 22 (not shown in FIG. 3), clampingly engage the upper plurality of sheets 40C.

The second clamping means 20 and 22 comprise a body 76 having a hook member 78 attached to one of its ends to permit detachable coupling from the member 42. The second clamping means 20 and 22 have an adjustable mechanism comprising a threaded screw member 80, first and second jaws 82 and 84 and a bracket member 86. The first and second jaws 82 and 84 are spaced apart from each other, in a parallel manner, by means of the bracket member 86. The first jaw member 82 has a threaded opening (not shown) through which the threaded screw member 80 extends. The extending end of screw member 80 has a resilient member 88 which operatively mates with another resilient member 90 which is attached to the second jaw member 84.

In operation, and with reference to both FIGS. 1 and 3 (in particular FIG. 3), when a user decides to extract one or more sheets 40B from the stacked sheets 40 in the flat storage drawer 24, the upper rack 12 and the sheet separator 14, along with its transverse members 46–56, are positioned in drawer 24 in a manner shown in FIG. 1. (It should be noted that feet 12A and 12B of the upright rack 12 are positioned outside (see FIG. 3) of the stack 40 so as not to weigh thereon). The first clamping means 16 and 18 are then clampingly engaged to the lower plurality of sheets 40A. (It should be noted that the use of two clamping means 16 and 18 are preferred, but one need only be used in some instances). The user may now earmark the upper plurality of sheet 40C, leaving the one or more sheets 40B to be retrieved resting upon the first clamping means 16 (see FIG. 3) and 18. The upper plurality of sheets 40C is then lifted upward, while at the same time, the sheet separator 14 is tucked under the plurality of sheets 40C as shown in FIG. 3. The plurality of sheets 40C is then arranged to provide an outwardly looped portion 92 and an inwardly looped portion 94 (as viewed in FIG. 3). After arranging these loops 92 and 94, the second clamping means 20 and 22 are adjusted so that the two resilient members 88 and 90 clampingly engage the segment 96 (see FIG. 3) of the plurality of sheets 40C. The looped portions 92 and 94 substantially remove the gravitational pull, created by the downwardly acting weight of the upper plurality of sheets 40C, from the clamping region at location 96. It should be noted that although it is preferred to have two loops 92 and 94, one such loop to remove the gravitational pull of the upper plurality of sheets 40C would suffice in many cases. It should also be noted that although it is preferred to use two clamping means 20 and 22, in many instances one such clamping means suffices.

After the one or two clamping means 20 or 22 is attached to the upper plurality of sheets 40C, the one or two clamping means, e.g., means 20 is detachably hung from member 42 as shown in FIG. 3. The one or more sheets 40B may now be easily removed from the flat storage drawer 24 without being hindered by the weight of the upper plurality of sheets 40C nor without disturbing the lower plurality of sheet 40A. Furthermore, the plurality of sheets 40A and 40C remain aligned within drawer 24 awaiting the refiling of sheet 40B and without losing the place of sheet 40B in the sequential stack 40. The retrieved and re-insertion of sheet 40B is accomplished without causing any tearing of itself and without causing any creasing or misalignment of itself or of any of the plurality of sheets 40A and 40C.

In another embodiment, and with reference to FIG. 1, the rack assembly 12 need not be used but, rather, the dust cover 26 may be used in the selective removal of the one or more sheets 40B. More particularly, after the sheet separator 14 is tucked under the upper plurality of sheets 40A and after the clamping means 16, 18, 20 and 22 have been attached to the lower and upper plurality of sheets 40A and 40 all in a manner as previously described, the clamping means 20 and 22 may be detachably hung from the vertically arranged dust cover 26. For such an arrangement, it is preferred that one loop, such as loop 92 or 94 be provided so as to assist in the removal or compensation of the gravitational pull caused by the weight of the upper plurality of sheet 40C.

It should now be appreciated that the practice of the present invention provides for various embodiments all of which allow a single user to selectively extract at least one sheet from a plurality of stacked sheets in a file storage drawer without mutilating the sheet either upon extraction or refiling.

The present invention may be embodied in other specific forms without departing from the spirit or essential attributes thereof and, accordingly, reference should be made in the appended claims, rather than to the foregoing specification, as indicating the scope of the invention.

I claim:

1. A portable arrangement for extracting at least one sheet from a plurality of sheets stacked in a flat storage drawer, having a predetermined width and runners thereon, said arrangement comprising:

(a) an upright rack having opposite feet that are interconnected by a crossbar;

(b) a sheet separator with a tapered front portion and having means for being mounted on at least one transverse spanning member which in turn has means for slidably coupling to said runners;

(c) first clamping means comprising at least one member having a surface for clampingly engaging at least one sheet located below the sheet desired to be extracted; and (d) second clamping means comprising at least one member having a surface for clampingly engaging at least one sheet located above the sheet desired to be extracted, said second clamping means having a body with one of its ends connected so as to permit detachable hanging from said crossbar.

2. A portable arrangement according to claim 1, wherein said crossbar has a transverse dimension which is slightly less than said predetermined width of said storage drawer.

3. A portable arrangement according to claim 1, wherein said crossbar has adjustable means to accommodate different storage drawers each having different predetermined widths.

4. A portable arrangement according to claim 1, wherein said at least one transverse spanning member has a transverse dimension which is slightly less than said predetermined width of said storage drawer.

5. A portable arrangement according to claim 1, wherein said at least one transverse spanning member has adjustable means to accommodate storage drawers each having different predetermined widths.

6. A portable arrangement according to claim 1, wherein said first clamping means has means located at one of its ends to permit detachable hanging.

7. A portable arrangement according to claim 1, wherein said second clamping means includes an adjustable mechanism comprising;

(i) first and second jaw members spaced apart from each other in a parallel manner by a bracket member, one of said first and second bar members having a threaded opening; and (ii) a threaded screw having a first end connected to the other end of said body and threadedly inserted into said opening, said threaded screw having a resilient member attached to its other end;

whereby said threaded screw is adjustable within said threaded opening to cause said resilient member and one of said first and second jaw members to clampingly engage said at least one sheet located above said sheet desired to be extracted.

8. A portable arrangement according to claim 1, wherein said at least one member of said first clamping means comprises a pair of lever members joined at their intermediate portions by a spring member, each of said lever members being yieldingly biased by said spring and each having an uneven surface for clamping engaging said at least one sheet located below the sheet desired to be extracted.

9. A portable arrangement for use in a drawer for storing a plurality of flat sheets, said drawer having a predetermined width, runners, a front wall, a rear wall, sidewalls and a cover member having means for being uprightly mounted at said rear wall, said arrangement comprising;

(a) a sheet separator with a tapered front portion and having means for being mounted on at least one transverse spanning member which in turn has means for slidably coupling to said runners;

(b) first clamping means comprising at least one member having a surface for clampingly engaging at least one sheet located below the sheet desired to be extracted; and (c) a second clamping means comprising at least one member having a surface for clampingly engaging at least one sheet located above the sheet desired to be extracted, said second clamping means having a body with one of its ends connected to means to permit detachable hanging from said dust cover.

10. A method of extracting at least one sheet from a plurality of sheets stacked in a flat storage drawer comprising the steps of:

(a) providing an upright member positioned at the rear of said storage drawer so as to span but not contact said plurality of sheets;

(b) providing a sheet separator mounted on at least one transverse member so as to span but not contact said plurality of sheets;

(c) providing first clamping means comprising at least one member having a surface for clampingly engaging at least one sheet located below the sheet desired to be extracted;

(d) providing second clamping means comprising at least one member having a surface for clampingly engaging at least one sheet located above the sheet desired to be extracted, said second clamping means having a body with one of its ends connected to means to permit detachable hanging from said upright member;

(e) searching through said plurality of sheets to locate the sheet desired to be extracted;

(f) clamping said first clamping means to the one or more sheets located below said sheet desired to be extracted;

(g) holding one end of the one or more sheets located above the sheet desired to be extracted and while so doing placing at least one loop in said sheets;

(h) clamping the said second clamping means to an upper portion of said looped sheets;

(i) detachably hanging said second clamping means from said upright member; and (j) extracting said sheet desired to be removed.

* * * * *